US006460842B1

(12) United States Patent
Koelle

(10) Patent No.: US 6,460,842 B1
(45) Date of Patent: Oct. 8, 2002

(54) DEVICE FOR SUPERPOSING SHEETS OF PAPER OR THE LIKE

(75) Inventor: Helmut Koelle, Augsburg (DE)

(73) Assignee: Boewe Systec AG, Augsburg (DE)

( * ) Notice: Subject to any disclaimer, the term of this patent is extended or adjusted under 35 U.S.C. 154(b) by 0 days.

(21) Appl. No.: 09/674,615

(22) PCT Filed: Apr. 17, 1999

(86) PCT No.: PCT/DE99/01187

§ 371 (c)(1),
(2), (4) Date: Nov. 1, 2000

(87) PCT Pub. No.: WO99/57049

PCT Pub. Date: Nov. 11, 1999

(30) Foreign Application Priority Data

May 2, 1998 (DE) ..... 198 19 736

(51) Int. Cl.[7] ..... B65H 3/44

(52) U.S. Cl. ..... 270/58.01; 270/52.09; 271/303; 271/9.11; 271/197; 271/9.13

(58) Field of Search ..... 270/52.01, 52.09, 270/58.01; 271/303, 304, 305, 197, 9.11, 9.13

(56) References Cited

U.S. PATENT DOCUMENTS 3,693,486 A * 9/1972 Maniaci et al. ..... 83/88
4,572,497 A * 2/1986 Dreschel et al. ..... 271/112
4,674,375 A * 6/1987 Golicz ..... 83/91
4,770,407 A * 9/1988 Nail ..... 271/275
4,927,000 A * 5/1990 Hoyland et al. ..... 198/418.4
5,083,769 A * 1/1992 Young, Jr. ..... 271/303 X
5,439,208 A * 8/1995 Moser et al. ..... 271/225
5,445,368 A * 8/1995 Lester et al. ..... 271/303 X
5,790,168 A * 8/1998 Sano et al. ..... 347/262
5,794,931 A * 8/1998 Heilman et al. ..... 271/303
6,062,556 A * 5/2000 McCay ..... 271/9.13
6,109,603 A * 8/2000 Stevens et al. ..... 270/52.07
6,341,773 B1 * 1/2002 Aprato et al. ..... 271/9.13

* cited by examiner

*Primary Examiner*—Christopher P. Ellis
*Assistant Examiner*—Patrick Mackay
(74) *Attorney, Agent, or Firm*—Flynn, Thiel, Boutell & Tanis, P.C.

(57) ABSTRACT

A device for superposing sheets of paper comprising a lower vacuum conveyance unit for one row of sheets of paper (R1) and an upper vacuum conveyance unit for another row of sheets of paper (R2). The ends of the vacuum conveyance units can be adjusted independently from each other, crosswise to the direction in which the paper advances (P). One vacuum conveyance unit can be adjusted in a slanted position in relation to the direction in which the paper advances (P) so that it cuts across the vacuum conveyance unit on the opposite side.

17 Claims, 5 Drawing Sheets

DEVICE FOR SUPERPOSING SHEETS OF PAPER OR THE LIKE

FIELD OF THE INVENTION

The invention relates to a device for superposing sheets of paper or the like, comprising longitudinal transport devices, by means of which the sheets of paper, which lie side-by-side in two parallel rows in a paper path, can be moved in direction of movement of the paper, which extends in direction of the rows, one after the other into an assembly station, comprising a lower vacuum conveyance unit arranged in the assembly station below the paper path and associated with the one row, by means of which lower vacuum conveyance unite two sheets of paper coming from different rows can be superposed in pairs, and comprising a discharge device, by means of which the sheets of paper, which are superposed in pairs, are discharged simultaneously from the assembly station, whereby the vacuum conveyance unit has a continuous conveyor belt provided with perforations, which conveyor belt is guided over two guide rollers supported in a carrier and over a vacuum chamber arranged therebetween, which vacuum chamber is open toward the upper operating strand of the conveyor belt, which operating strand borders the paper path.

BACKGROUND OF THE INVENTION

The device of the invention is used to superpose sheets of paper, for example forms which exit a cutting machine via a 2-path operation. A similar purpose is served by a conventional device of the abovementioned type according to the DE 34 33 497 A1. The sheets of paper lying side-by-side in two rows are in this conventional device fed one after the other into the assembly station. A perforated, continuous conveyor belt, which extends transversely to the direction of movement of the paper and is guided over a vacuum chamber, is provided in the assembly station. With this conveyor belt it is possible to move a sheet of paper coming from the first row of sheets of paper transversely with respect to the direction of movement of the paper over the other sheet of paper originating in the second row of sheets of paper and already in the assembly station. During the transverse transport of the one sheet of paper not only the other sheet of paper must be stopped but also the feeding of further sheets of paper must be interrupted. Only when the two sheets of paper, which are in the assembly station, have been completely superposed, they can be discharged from the assembly station by means of further continuous conveyor belts arranged in the direction of movement of the paper. The vacuum conveyance unit is in a modification of this conventional device arranged symmetrically in the center between both sheets of paper, and the conveyor belt can be driven selectively in the one or other direction. It is possible in this manner to place selectively sheets of paper originating from the first row of sheets of paper above sheets of paper of the second row of sheets of paper and vice versa. However, this conventional device operates surely discontinuously cyclically, namely the feeding of sheets of paper and the discharge of sheets of paper must be interrupted in each case during the time which is needed for the transverse movement of each sheet of paper in the assembly station. This results in a relatively long cycle time and accordingly in a low performance. Also the cyclical operation of the device causes greater noises. Furthermore several stop bars are needed in the assembly station in order to assure the exact alignment of the sheet of paper to be moved transversely. These stops must be newly adjusted for each format change. Furthermore the conventional device permits always only the movement of one sheet of paper toward one or toward the other side of the device, namely a superposing with a fixed edge on the right or on the left. A center-symmetrical superposing of sheets of paper is not possible. The conventional device can also not be used universally for other methods of operation.

SUMMARY OF THE INVENTION

Therefore the basic purpose of the invention is to provide a device for superposing of sheets of paper or the like of the abovementioned type, which is distinguished in particular by a high performance, thereby operating precisely and safely, which demands little conversion operations during format change and can be adjusted universally for several different methods of operation.

This is attained according to the invention:

- by at least one similar upper vacuum conveyance unit arranged above the paper path being associated with the other row of sheets of paper, of which upper vacuum conveyance unit the lower operating strand of the conveyor belt borders the paper path, and the vacuum chamber of which is open toward the lower operating strand,
- by the two ends of each carrier, which ends carry each one of the guide rollers of the associated conveyor belt, being arranged one behind the other in direction of movement of the paper, and being able to be adjusted independently from one another transversely with respect to the direction of movement of the paper each by means of an adjusting device,
- by a separating plate extending in the paper path being provided in the assembly station between the lower and the upper vacuum conveyance unit, and
- by a guiding device being provided in the direction of movement of the paper in front of the separating plate for each row of sheets of paper, by means of which guiding device the sheets of paper originating from the one row are each fed to the operating strand of the conveyor belt of the vacuum conveyance unit associated with the row,
- whereby to superpose the sheets of paper at least the carrier of one vacuum conveyance unit can be adjusted transversely with respect to the direction of movement of the paper by means of the adjusting device in such a manner that its conveyor belt crosses in the outlet-side area of the assembly station the conveyor belt of the vacuum conveyance unit arranged on the opposite side of the separating plate.

Thus the invention is based on the premise to associate each separate vacuum conveyance unit with the sheets of paper coming from each row of sheets of paper, of which vacuum conveyance units the vacuum conveyance unit associated with the one row of sheets of paper is arranged below and the other vacuum conveyance unit associated with the other row of sheets of paper is arranged above the plane of sheets of paper. The invention is furthermore based on the premise of arranging the vacuum conveyance units in such a manner that their conveyor belts extend essentially in direction of movement of the paper, and that the position of the conveyor belts relative to the direction of movement of the paper can be adjusted precisely by means of adjusting devices. In order to superpose the sheets of paper, the vacuum conveyance units can now be adjusted selectively in such a manner that, for example, the conveyor belt of the lower vacuum conveyance unit extends in direction of movement of the paper and the conveyor belt of the upper vacuum conveyance unit inclined with respect to the direction of movement of the paper. In this manner all sheets of paper are moved by the upper vacuum conveyance unit toward the side of the device where the lower vacuum conveyance unit is, and a method of operation with a fixed edge on the one side of the device is possible. When the fixed edge is to be on the other side of the device, the upper vacuum conveyance unit is adjusted in such a manner that its conveyor belt extends in direction of movement of the paper, and its lower vacuum conveyance unit so that its conveyor belt extends inclined with respect to the direction of movement of the paper. However, it is also possible to adjust the lower and the upper vacuum conveyance unit in such a manner that the conveyor belts of both vacuum conveyance units extend inclined with respect to the direction of movement of the paper toward the longitudinal center plane of the device, which causes then the sheets of paper originating from both rows of sheets of paper to be moved in the assembly station each toward the longitudinal center plane, and a center-symmetrical paper processing is possible. Further methods of operation of the new device will be discussed later on in connection with the drawings. Important for the new device is that by positioning the conveyor belt or the conveyor belts at an incline with respect to the direction of movement of the paper the superposing of the sheets of paper can occur continuously. The sheet of paper originating from one row of sheets of paper is fed continuously in direction of movement of the paper and the sheet of paper originating from the other row of sheets of paper is fed continuously inclined thereto or the sheets of paper originating from both rows of sheets of paper are fed continuously inclined with respect to the direction of movement of the paper and are thereby superposed in the assembly station depending on the adjustment of the conveyor belts. A significantly higher performance is possible with the continuous method of operation of the new device compared with conventional devices, for example the device mentioned in the beginning. Thus it is, for example, possible to process with the new device using a format height of approximately 75 mm (3 inches) 100,000 sheets per hour, whereas the present operating performance was only 25,000 sheets per hour. The new device also operates significantly quieter because of the continuous method of operation. In addition a change in format demands only few change-over operations since the edge-exact superposing of the sheets of paper can be adjusted precisely by adjusting the inclined position of the conveyor belts without the necessity of stops. Since no stops are needed, it is also possible for the sheets of paper of the one row of sheets of paper to have a different width than the ones of the other one (asymmetric longitudinal cross section).

Advantageous developments of the invention are characterized in the subclaims.

BRIEF DESCRIPTION OF DRAWINGS

The invention will be discussed in greater detail hereinafter in connection with one exemplary embodiment illustrated in the drawings, in which.

DETAILED DESCRIPTION

Figure 1:
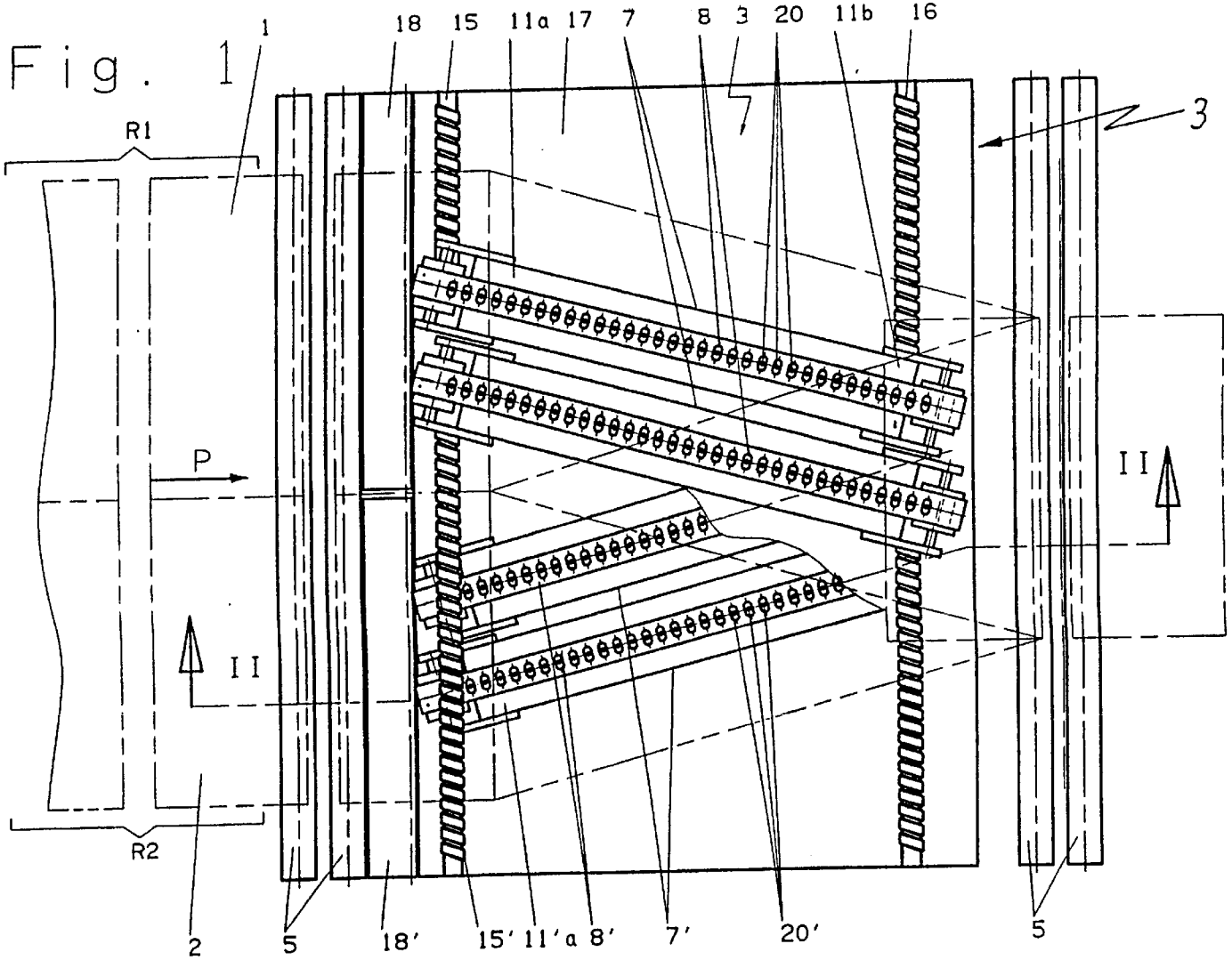
FIG. 1 is a top view of the device.

A not illustrated, printed paper web is divided into individual sheets of paper 1, 2 in a cutting machine (also not illustrated) first lengthwise and then also transversely thereto. The sheets of paper 1, 2 lie side-by-side in two parallel rows R1 and R2 in a horizontal paper path E—E and are fed by a not illustrated transport mechanism in the direction of movement of the paper to the assembly station 3 illustrated in FIGS. 1 and 2. The direction of movement P of the paper extends in direction of the rows R1 and R2.

Draw-in transport rollers 4 exist at the input of this assembly station, which rollers are continuously driven by the motor M1. The draw-in transport rollers 4 are rollers with a smooth surface, against which the sheets of papers are pressed in a conventional manner by means of pressure rollers 5. Two similarly designed output transport rollers 6 exist at the output of the assembly station, which rollers can be continuously driven by a motor M2. The draw-in transport rollers 4 and the output transport rollers 6 can also be driven by a common motor with the interpositioning of toothed belts.

The device of the invention has first of all at least one lower vacuum conveyance unit 7. However, it is advantageous to provide two parallel lower vacuum conveyance units 7, since this can further improve the operating exactness and the operating safety of the device. The two lower vacuum conveyance units 7 are arranged below the paper path E—E and are each associated with one of the two rows R1 or R2 of sheets of paper. Each of these vacuum conveyance units 7 has an endless conveyor belt 8 with perforations 20 therein. The conveyor belt 8 is guided over two guide rollers 9, 10, of which the guide roller 9 can be driven by the schematically indicated motor M3. The motor M3 can at the same time also be used to drive the guide roller 9 of the second lower vacuum conveyance unit 7. The guide rollers 9, 10 are arranged at opposite ends of a carrier 11. A vacuum chamber 12 is furthermore provided between the two guide rollers 9, 10, which vacuum chamber is integrated into the carrier 11 in the illustrated exemplary embodiment. This vacuum chamber 12 is open toward the upper operating strand 8*a* of the conveyor belt 8. The upper operating strand 8*a* borders the paper path E—E and is arranged only a small distance below the paper path.

The vacuum chamber 12 is divided in its longitudinal direction advantageously into individual chambers 12*a*, 12*b*, 12*c* in order to adjust the device to various format heights. The individual chambers can selectively be connected to a vacuum source 13. Only the middle individual chamber 12*d* can be continuously connected to the vacuum source 13. Each of the individual chambers 12*a*–12*d* has a longitudinal slot 14*a*–14*d* open toward the operating strand 8*a*.

Instead of dividing the vacuum chambers 12 into individual chambers, it is also possible to provide one single continuous vacuum chamber having a longitudinal slot open toward the operating strand 8*a*. It would then be possible by using not illustrated slides to close off the end areas of the slot at a predetermined length in dependency of the format height of the sheets of paper which are to be superposed.

Figure 2:
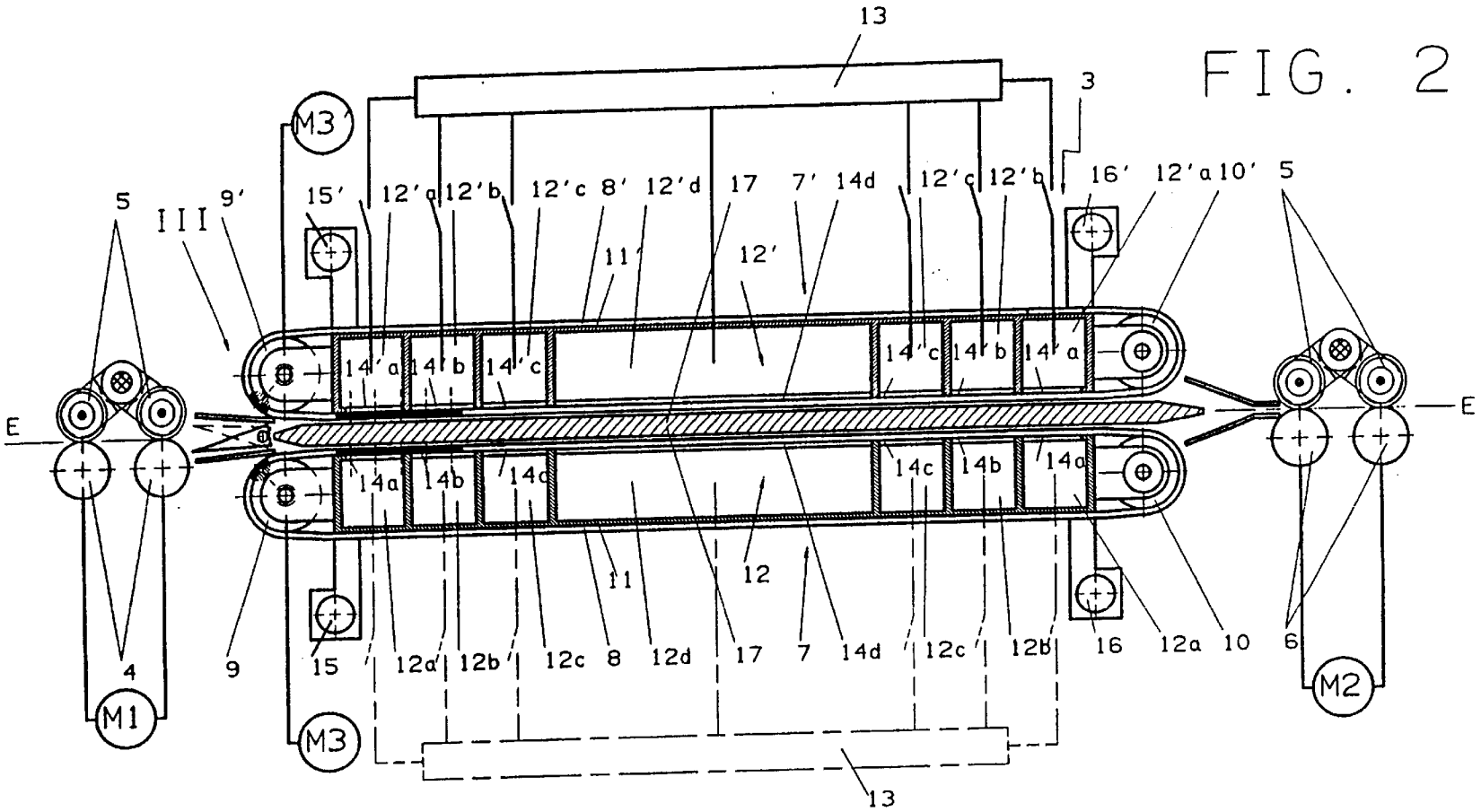
FIG. 2 is a longitudinal cross-sectional view taken along the line II—II of FIG. 1.

FIG. 1 furthermore shows that the two ends 11*a* and 11*b* of the carrier 11 are arranged offset to one another in the direction of movement of the paper P. The ends 11*a*, 11*b* can be adjusted independently from one another by means of an adjusting device 15 and 16, which is designed advantageously as a screw spindle extending perpendicularly with respect to the direction of movement P of the paper and parallel with respect to the paper path E—E. The adjusting devices 15, 16 can each be driven manually or by means of a stepping motor.

At least one upper vacuum conveyance unit 7', which is arranged above the paper path E—E, is provided for the second row R2 of sheets of paper. It is here also advantageous to associate with the row R2 of sheets of paper two vacuum conveyance units 7' which are arranged parallel to one another. The upper vacuum conveyance units 7' are designed similarly to the lower vacuum conveyance units 7', for which reason the upper vacuum conveyance units 7', their parts and the structural parts cooperating with them are identified with the same reference numerals as the vacuum conveyance units 7 and their parts, but with a prime mark added thereto. Thus, the above description of the lower vacuum conveyance units 7 applies also in sense to the upper vacuum conveyance units 7'. The upper vacuum conveyance units 7' differ from the lower ones merely in that in the upper vacuum conveyance units 7' in each case the lower stand 8'*a* of the conveyor belt 8' forms the operating strand and the vacuum chambers 12' are accordingly downwardly open. The lower operating strand 8'*a* is arranged adjacent to the paper path E—E at a small distance from the paper path.

In order for the operating strands 8*a* and 8'*a* to be arranged as close as possible below or above the paper path, and in order for the sheets of paper 1, 2 having to be deflected as little as possible from this paper path, it is advantageous to provide between the lower vacuum conveyance units 7 and the upper vacuum conveyance units 7' a thin separating plate 17 extending in the plane of the paper path. The two sheets of paper 1, 2, which are supposed to be superposed, are guided separate from one another during the superposing by this separating plate 17, and it is furthermore most of all prevented that the upper sheet of paper is sucked in by the lower vacuum conveyance units 7 and the lower sheet of paper by the upper vacuum conveyance units 7'. The separating plate 17 can also consist of a transparent material, as for example an acrylic plastic or glass, for which reason in FIG. 1 also the vacuum conveyance units 7 lying below the transparent separating plate 17 and the structural parts cooperating with the units can be recognized.

Figure 3:
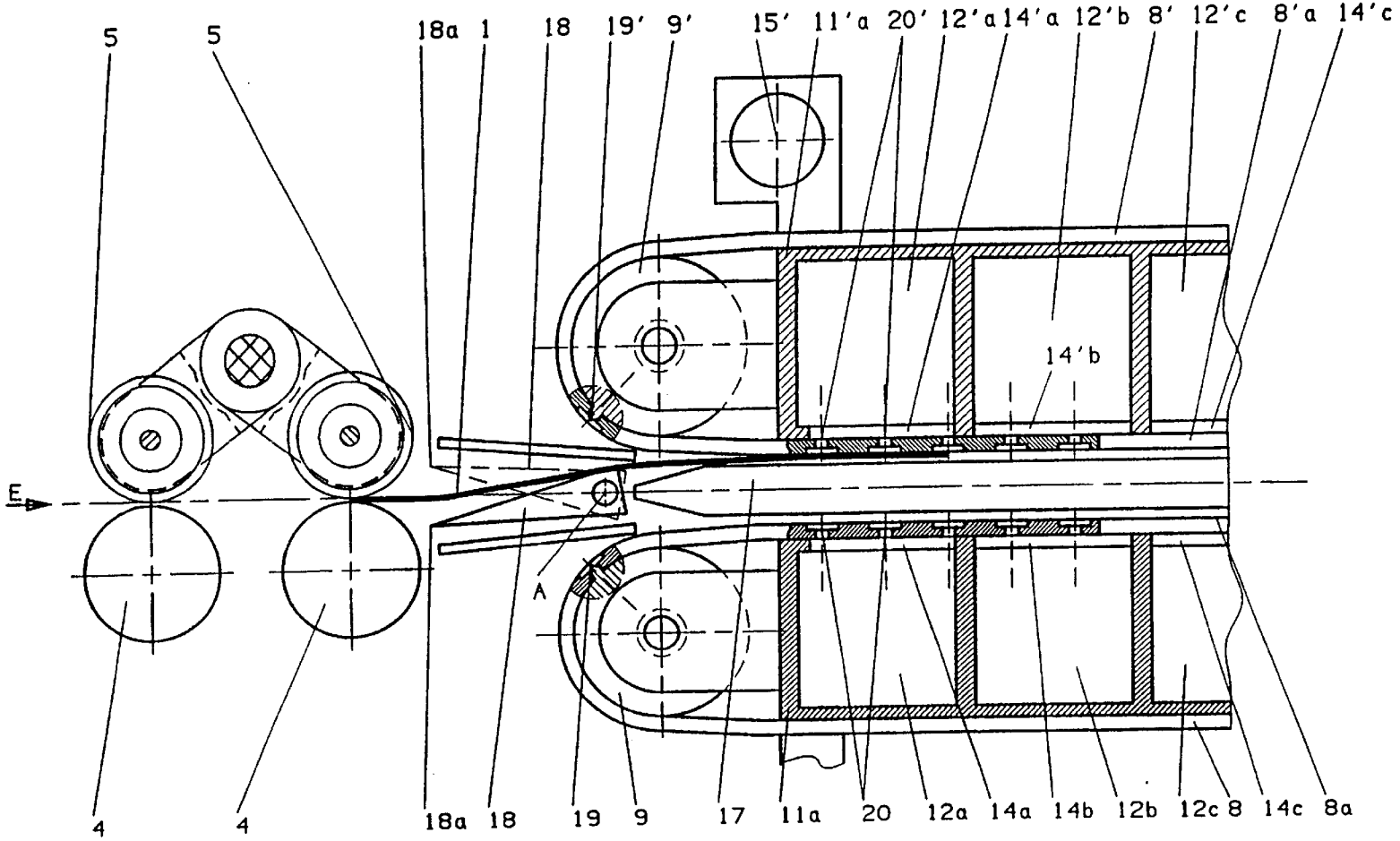
FIG. 3 is a partial longitudinal cross-sectional view at the point III of FIG. 2, FIGS. 4–11 show schematic illustrations of various methods of operation of the device.

In order to assure that the respective sheet of paper is fed to the associated vacuum conveyance units, a guiding device 18, 18' is provided in front of the separating plate 17 for each row R1, R2 of sheets of paper. In order to be able to adapt the device to various methods of operation, the inlet end 18*a* or 18'*a* of each guiding device 18 is elevationally adjustable. The two guiding devices 18, 18' are advantageously designed like a flapper plate and can be pivoted about a swivel axis A extending in the paper path E—E and perpendicularly with respect to the direction of movement of the paper. In this manner it is possible to guide the sheets of paper originating from one of the rows R1, R2 of sheets of paper selectively to the upper or to the lower side of the separating plate and the sheets of paper of the other row of sheets of paper to the opposite lower or upper side of the separating plate 17. When, for example, the sheets of paper 1 originating from the row R1 of sheets of paper are to be advanced by the lower vacuum conveyance unit 7, then the guiding device 18, as illustrated in FIG. 3, is pivoted upwardly. The sheets of paper 1 of the row R1 of sheets of paper are in this manner guided to the operating strand 8*a* of the lower vacuum conveyance units 7. The guiding device 18' with its inlet end 18'*a* is then folded downwardly for the row R2 of sheets of paper and the sheets of paper 2 are thus guided to the operating strand 8'*a* of the upper vacuum conveyance units 7'. Whereas when further sheets of paper, which are not cut longitudinally and the width of which corresponds to the sum of the widths of the sheets of paper 1, 2, are to be processed, then both guiding devices 18, 18' are pivoted toward the same side with respect to the paper path E—E.

In order to assure a precise operation of the device, it is furthermore advantageous when the driven guide rollers 9, 9' have projections 19, 19', which extend into corresponding recesses in the associated conveyor belt 8, 8'. The recesses can thereby, as in the illustrated exemplary embodiment, be formed by the perforations 20, 20' of the conveyor belt 8, 8'. The conveyor belts, however, can also be designed like a toothed belt, and the driven guide rollers have then a corresponding tooth system on their peripheries.

Figure 4:
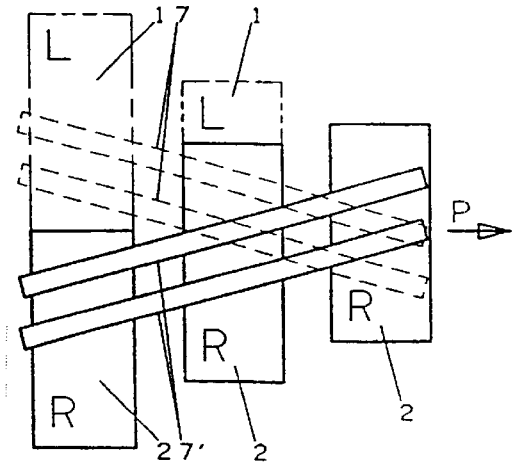

The operation of the device of the invention will now be described in connection with FIGS. 1–4 in a first method of operation. The sheets of paper 1, 2 originating from the two rows R1, R2 of sheets of paper are in this method of operation to be superposed alternately, which in the technical language is identified as a "2-path-slalom operation". The sheet of paper 2, which is the right one in direction of movement of the paper, is hereby to be placed above the left sheet of paper 1. Furthermore the sheets of paper are to be superposed symmetrically with respect to the longitudinal center plane of the device, which is identified as "center-symmetrical processing". The lower vacuum conveyance units 7 are for this purpose utilized for the transport of the sheets of paper 1 originally from the left row R1 of sheets of paper and the upper vacuum conveyance units 7' for the transport of the sheets of paper 2 originating from the right row R2 of sheets of paper. The guiding devices 18, 18' are thereby adjusted as illustrated in FIG. 3. The lower vacuum conveyance units 7 are with their ends on the outlet side adjusted inclined with respect to the longitudinal center plane, just like the upper vacuum conveyance units 7' are in the opposite direction also with their ends on the outlet side adjusted inclined toward the longitudinal center plane, as it is illustrated in FIGS. 1 and 4.

The sheets of paper 1, 2 are moved by the transport rollers 4 of the draw-in transport in the direction of movement of the paper P. The sheet of paper 1 is hereby guided by the guiding device 18 to the operating strand 8*a* of the lower vacuum conveyance units 7, and the sheet of paper 2 by the guide device 18' to the operating strand 8'*a* of the upper vacuum conveyance units 7'. The sheet of paper 1 is sucked onto the operating strand 8*a* by the vacuum existing in the vacuum chamber 12, which vacuum becomes active initially through the slot 14*a* and later also through the slots 14*d*, 14*c* and 14*d* and the perforations 20, and is taken over by the continuously moving conveyor belt 8. Through the inclined position of the conveyor belt with respect to the longitudinal center plane, the sheet of paper 1 is advanced simultaneously in direction of movement of the paper P and also toward the longitudinal center plane. The sheet of paper 2 is in a similar manner taken over by the operating strand 8'*a* of the conveyor belt 8' of the upper vacuum conveyance units 7' and is laterally offset in opposite direction toward the longitudinal center plane. Each sheet of paper is thereby offset only at half of the width of the sheet of paper. The two sheets of paper are superposed at the outlet side of the device. An edge-exact superposing of the sheets of paper 1, 2 can be adjusted by a suitable adjustment of the vacuum conveyance units 7, 7' by means of the adjusting devices 16, 16'.

Figure 5:
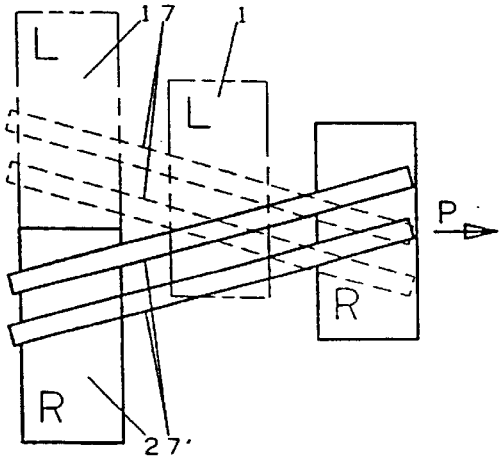

The superposed sheets of paper 1, 2 are then picked up by the transport rollers 6 of the output transport and are advanced. When, for example, at the end of the group according to FIG. 5 only one sheet of paper (path) of the row R1 is yet to be given out, then the upper vacuum conveyance units 7' associated with the other row R2 and thus the sheet of paper 2 picked up by the units are temporarily stopped. The forerunner, for example the cutting machine, must during this time also be stopped. As soon as the individual sheet of paper 1 has reached the outlet end of the lower vacuum conveyance units 7, the upper vacuum conveyance units 7' and the forerunner are again started.

Figure 6:
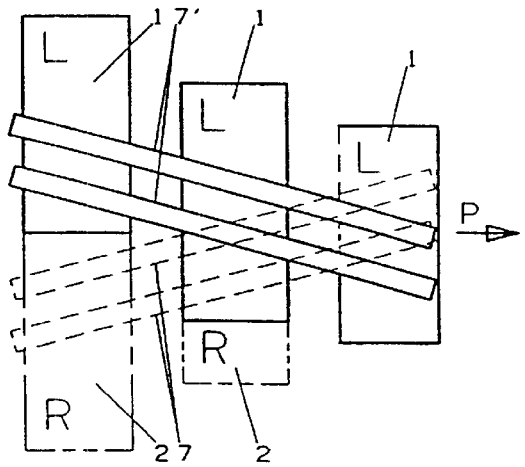
Figure 7:
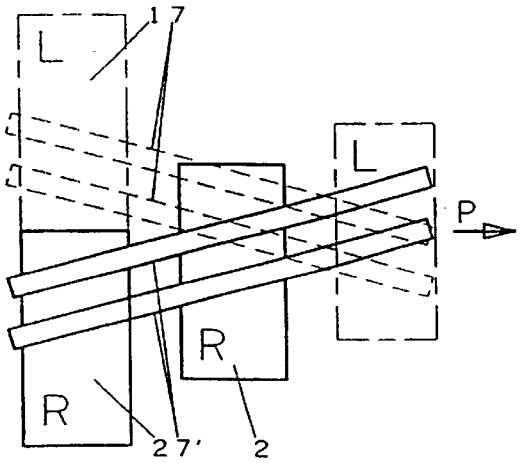

When in a similar method of operation the left sheet of paper 1 is to be placed over the right sheet of paper, then the vacuum conveyance units are adjusted by means of the adjusting devices 15, 16 corresponding to FIGS. 6 and 7. The guiding devices 18, 18' are also adjusted accordingly. The upper vacuum conveyance devices 7' take then in this case over the transport of the left sheet of paper 1 and the lower vacuum conveyance devices 7 the transport of the right sheets of paper 2.

Figure 8:
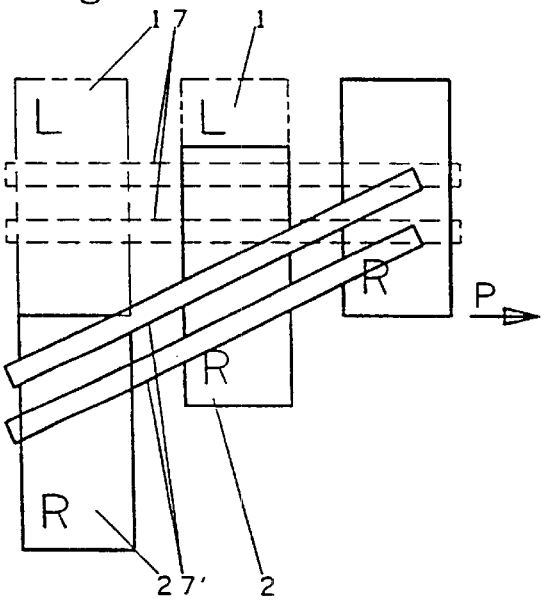
Figure 9:
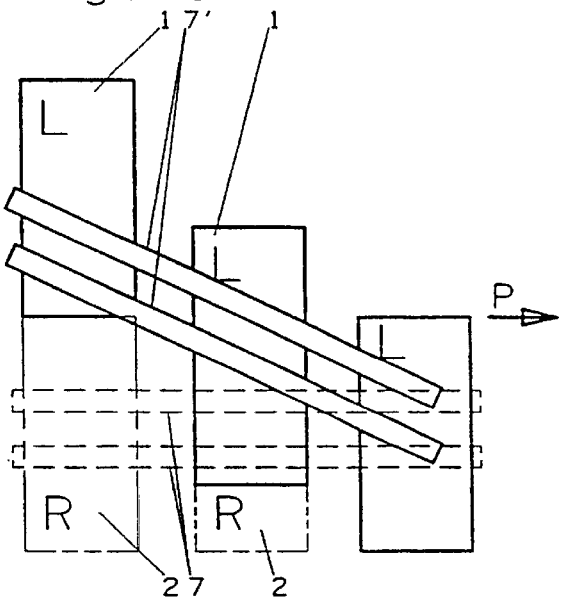

FIG. 8 shows how by adjusting the lower vacuum conveyance units 7' parallel to the direction of movement P of the paper and the upper vacuum conveyance units 7' inclined to the direction of movement P of the paper the sheets of paper 2 coming from the right row R2 of sheets of paper can be offset to the left, whereas the sheets of paper 1 coming from the right row R1 of sheets of papers are advanced only straight ahead. The paper can in this manner be processed with "fixed edge left".

With the opposite inclined position of the upper vacuum conveyance units 7' a "2-uses processing" with "fixed edge right" can occur.

Figure 10:
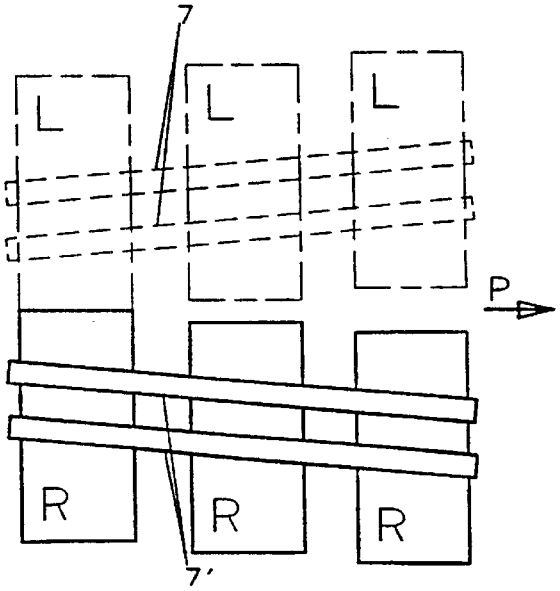

FIG. 10 shows a method of operation with a "2-path-column operation". The vacuum conveyance units 7 and 7' are hereby adjusted slightly inclined outwardly. The sheets of paper 1, 2, which are initially in contact with one another in the longitudinal center plane, are thus separated in the center from one another, and are spaced apart, which is advantageous for a good stack formation.

Figure 11:
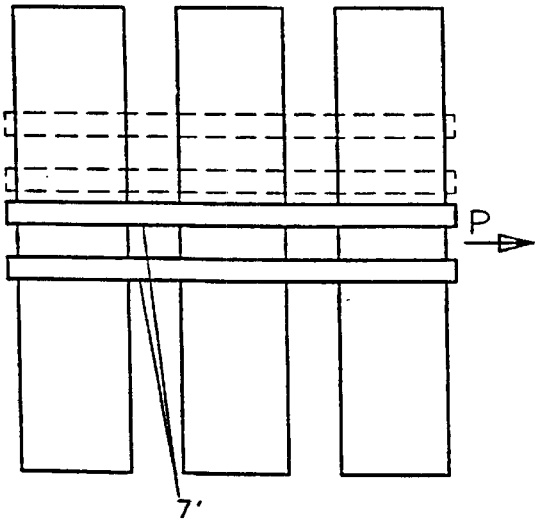

FIG. 11 shows the device in the so-called "1-path operation". Here only one sheet of paper is processed which, however, is twice as wide as the sheets of paper in the previous exemplary embodiments. Either only the upper vacuum conveyance devices or the lower vacuum conveyance devices are used in this case, and both guiding devices 18, 18' are adjusted in such a manner that they guide the sheets of paper either only upwardly or only downwardly.

The device can be operated either manually or by means of a preprogrammed control which acts onto the motors connected to the screw spindles 15, 15' or 16, 16'.

The dividing of the vacuum chambers 12 or 12' into several individual chambers or the covering of the end areas of the slot of a continuous vacuum chamber is necessary in order to adapt the device to various format heights. In the case of the smallest format height of, for example, 75 mm (3 inches) all individual chambers 12*a*–12*d* or 12'*a*–12'*d* are connected to the vacuum source. When using slides the longitudinal slot of the continuous vacuum chamber must in this case be opened over its full length. However, when sheets of paper with a larger format height are to be processed, then attention must be paid that these sheets of paper are only then sucked against the conveyor belts 8, 8' of the vacuum conveyance units 7, 7' when the rear edge of the respective sheet of paper just leaves the last transport roller of the draw-in transport. The respective sheets of paper may remain sucked onto the conveyor belts 8, 8' on the outlet side of the device only until the front edge of the respective sheet of paper is picked up by the first transport roller of the output transport. In order to assure this, a more or less large number of draw-in chambers 12*a*, 12*b*, 12*c* or 12'*a*, 12'*b*, 12'*c* are switched off from the vacuum source 13 on the inlet side and on the outlet side of the vacuum conveyance units 7, 7' depending on the format height of the sheets of paper, or the end areas of the slot of a continuous vacuum chamber are closed off over a more or less long length by the slide.

What is claimed is:

1. A device for superposing of sheets of paper, comprising:

longitudinal transport devices for transporting sheets of paper that lie side-by-side in two parallel rows in a paper path (E—E) in a direction of movement (P) of the sheets of paper that extends in the direction of the rows, said transporting devices moving the sheets of paper from the corresponding row one after the other, an assembly station for receiving the sheets of paper comprising:

a lower vacuum conveyance unit arranged below the paper path and associated with one of the rows, the lower vacuum conveyance unit receiving the sheets of paper coming from the one row; and a discharge device for receiving the sheets of paper, which are superposed in pairs, and discharged simultaneously from the assembly station, wherein the lower vacuum conveyance unit includes a first continuous conveyor belt provided with perforations, said conveyor belt being guided over two guide rollers supported in a carrier and through a lower vacuum chamber arranged therebetween, said vacuum chamber being open toward an upper operating strand of the first conveyor belt that borders the paper path, wherein at least one upper vacuum conveyance unit arranged above the paper path (E—E) is associated with the other row of sheets of paper, wherein a lower operating strand of a second conveyor belt borders the paper path, and an upper vacuum chamber opens toward the lower operating strand, wherein two ends of the carriers each carry one of the guide rollers of the respective conveyor belt, are arranged one behind the other in the direction of movement (P) of the sheets of paper, and are adjustable independently from one another transversely with respect to the direction of movement of the sheets of paper by respective adjusting devices, wherein in the assembly station between the lower and the upper vacuum conveyance units, a separating plate is provided extending in the paper path (E—E), and wherein a guiding device is provided in the direction of movement (P) of the paper in front of the separating plate for each row of the sheets of paper, the guiding devices operating so that the sheets of paper originating from each row are each fed to the respective operating strand of the respective conveyor belt of the respective vacuum conveyance unit associated with the row, and wherein, to superpose the sheets of paper, at least the carrier of one of said vacuum conveyance units is adjustable transversely with respect to the direction of movement (P) of the paper by the adjusting device so that the conveyor belt crosses, in an outlet-side area of the assembly station, the corresponding conveyor belt of the other vacuum conveyance unit arranged on the opposite side of the separating plate.

2. The device according to claim 1, wherein each row includes an additional vacuum conveyance unit such that the pair of vacuum conveyance units for each row are arranged parallel to one another and associated with the sheets of paper for each of the rows, whereby the two vacuum conveyance units associated with one row are arranged on the same side of the separating plate and the ends thereof are adjustable together in pairs.

3. The device according to claim 1, wherein an inlet end of each said guiding device is elevationally adjustable so that the sheets of paper originating from one row of the sheets of paper are capable of being guided selectively to the upper or the lower side of said separating plate and the sheets of paper of the other row of the sheets of paper to the opposite lower or upper side of said separating plate.

4. The device according to claim 3, wherein the guiding devices each comprise a flapper plate pivotable independently from each other about a swivel axis (A) extending in the paper path (E—E) and transverse to the direction of movement (P) of the paper.

5. The device according to claim 1, wherein the vacuum chamber is integrated into the carrier of the vacuum conveyance unit.

6. The device according to claim 1, wherein each of the vacuum chambers is divided in its longitudinal direction into individual chambers connected selectively to one vacuum source, and includes a longitudinal slot extending in a longitudinal direction of the associated conveyor belt and opening toward the operating strand of the associated conveyor belt.

7. The device according to claim 1, wherein each of the vacuum chambers include a longitudinal slot extending in a longitudinal direction of the associated conveyor belt and opening toward the operating strand for the associated conveyor belt, and wherein slides are provided for closing off end areas of the slot over a predetermined length in dependency of format height of the sheets of paper to be superposed.

8. The device according to claim 1, wherein the conveyor belts of the vacuum conveyance units are continuously driven during normal operation.

9. The device according to claim 1, wherein one of the guide rollers of each of the vacuum conveyance units is driven, the driven guide roller including projections that extend into corresponding recesses in the corresponding conveyor belt.

10. The device according to claim 9, wherein the recesses are formed by the perforations in the conveyor belt.

11. The device according to claim 9, wherein the conveyor belt comprises a toothed belt.

12. The device according to claim 1, wherein the ends of the carriers are adjustable by screw spindles arranged transversely with respect to the paper path (E—E).

13. The device according to claim 12, said assembly station including a motor for driving the screw spindles.

14. A device for superposing sheets of paper comprising:

at least one longitudinal transport device for transmitting two parallel rows of sheets of paper which lie side-by-side along a paper path in a direction of movement that extends in the direction of the rows;

an assembly station for receiving the parallel rows of the sheets of paper and superposing sheets of paper from one of the rows onto the sheets of paper from the other parallel row, comprising:

a lower vacuum conveyance unit for receiving sheets of paper from one of the rows, the lower vacuum conveyance unit comprising:

a lower carrier;

two lower guide rollers supported by said lower carrier;

a continuous lower conveyor belt supported by said lower guide rollers having a lower operating strand with perforations; and a lower vacuum chamber arranged in said lower carrier between said lower guide rollers, said lower vacuum chamber being open toward the lower operating strand of said lower conveyor belt bordering the paper path, said lower vacuum chamber supporting the lower operating strand;

an upper vacuum conveyance unit for receiving sheets of paper from the other one of the rows, the upper vacuum conveyance unit comprising:

an upper carrier;

two upper guide rollers supported by said upper carrier;

a continuous upper conveyor belt supported by said upper guide rollers and having an upper operating strand with perforations; and an upper vacuum chamber arranged in said upper carrier between said upper guide rollers, said upper vacuum chamber being open toward the operating strand of said upper conveyor belt bordering the paper path, said upper vacuum chamber supporting the upper operating strand;

a lower adjusting device for adjusting one end of said lower carrier transversely with respect to the direction of movement of the sheets of paper;

an upper adjusting device for adjusting one end of said upper carrier transversely with respect to the direction of movement of the sheets of paper;

a lower guiding device provided in the direction of movement of the paper path for guiding the sheets of paper from the first row to the lower strand of the lower conveyor belt;

an upper guiding device provided in the direction of movement of the paper path and adjacent the lower guiding device for guiding the sheets of paper from the second row to the upper strand of the upper conveyor belt; and a separating plate extending in the paper path downstream from said guiding devices, said separating plate being positioned between said lower vacuum conveyance unit and said upper vacuum conveyance unit to separate the sheets of paper of the first row and carried by the lower conveyor belt from the sheets of paper of the second row carried by the upper conveyor, wherein at least one of said vacuum conveyance units is adjustable in an inclined direction with respect to the direction of movement of the sheets of paper so that the corresponding conveyor belt crosses, in an outlet-side area of the assembly station, the corresponding conveyor belt of the other vacuum conveyance unit.

15. The device according to claim 14, wherein the lower vacuum conveyance unit comprises a first lower vacuum conveyance unit, the device including a second lower vacuum conveyance unit arranged parallel to said first lower vacuum conveyance unit, said first and second lower vacuum conveyance units being positioned on the same side of said separating plate and adjustable by said lower adjusting device, wherein said upper vacuum conveyance unit comprises a first upper vacuum conveyance unit, the device includ ing a second upper vacuum conveyance unit arranged parallel to said first lower vacuum conveyance unit, said first and second upper vacuum conveyance units being positioned on the same side of said separating plate, opposite from said first and second lower vacuum conveyance units, and adjustable by said lower adjusting device.

16. The device according to claim 14, wherein said lower vacuum chamber and said upper vacuum chamber are divided into a plurality of individual chambers connected to a single vacuum source, said vacuum chambers providing a vacuum through the perforations of said lower and upper operating strands to support the paper sheets.

17. The device according to claim 14, comprising a discharge device including rollers for continuously receiving the sheets from said lower vacuum conveyance unit and said upper vacuum conveyance unit traveling along the paper path, the sheets from the upper vacuum conveyance unit being separated from the sheets of the lower vacuum conveyance unit until passing an end of said separating plate whereat the sheets are superposed with each other.

* * * * *